United States Patent [19]

Keefer

[11] Patent Number: 4,656,325

[45] Date of Patent: Apr. 7, 1987

[54] MICROWAVE HEATING PACKAGE AND METHOD

[76] Inventor: Richard M. Keefer, 630 Bolivar Street, Peterborough, Ontario, Canada, K9J 4S2

[21] Appl. No.: 662,992

[22] Filed: Oct. 19, 1984

[30] Foreign Application Priority Data

Feb. 15, 1984 [CA] Canada ..... 447471

[51] Int. Cl.[4] ..... H05B 6/64

[52] U.S. Cl. ..... 219/10.55 E; 219/10.55 F; 219/10.55 M; 426/107; 426/243; 99/DIG. 14

[58] Field of Search ..... 219/10.55 E, 10.55 F, 219/10.55 M, 10.55 R; 126/390; 99/DIG. 14, 451; 426/107, 243, 241, 234

[56] References Cited

U.S. PATENT DOCUMENTS 3,219,460 11/1965 Brown ..... 219/10.55 E
3,302,632 2/1967 Fichtner ..... 219/10.55 E
3,974,354 8/1976 Long ..... 426/241 X
3,985,990 10/1976 Levinson ..... 219/10.55 E
4,230,924 10/1980 Brastad et a. ..... 426/107 X
4,398,077 8/1983 Freedman et al. ..... 99/451 X
4,495,392 1/1985 Derby ..... 219/10.55 E

*Primary Examiner*—Philip H. Leung
*Attorney, Agent, or Firm*—Cooper, Dunham, Griffin & Moran

[57] ABSTRACT

A novel cover arrangement is described for use with foodstuff holding pans to be heated in a microwave oven. The cover is one which in terms of microwave energy, does not transmit reflected energy. Thus, the cover acts in a manner analogous with non-reflecting coatings in optics and permits passage of the microwave radiation into the container holding the foodstuff, while substantially preventing escape of microwave radiation reflected from the foodstuff surface and container bottom. In this manner the microwave energy is retained and concentrated within the container, resulting in more efficient and uniform heating of the foodstuff. The novel cover is particularly valuable when used with aluminum foil pans, which without the cover of this invention seriously reflect microwave radiation.

25 Claims, 4 Drawing Figures

MICROWAVE HEATING PACKAGE AND METHOD

The present invention relates to microwave energy cooking and more particularly to an improved package for foodstuffs to be heated or cooked with microwave energy.

The heating of foodstuffs with microwave energy has now become commonplace. It is, of course, highly desirable to be able to heat foodstuffs in an inexpensive disposable shipping, heating and serving container or package. The most desirable such container or package for foodstuffs has traditionally been made from a metal foil, such as aluminum foil. The use of aluminum foil for this purpose has many advantages including economy, ease of manufacture, container strength, sanitation, etc.

However, there have remained some very serious drawbacks in the use of aluminum foil containers, e.g. pans, as microwave heating containers in that the aluminum is a conductor which acts as a shield and tends to reflect the microwave radiation. The reflective qualities of the aluminum foil results in uneven heating of the foodstuff in the container. Moreover, the reflected radiation may damage the oven, including the magnetron, and it may also upset the tuning of the oven, resulting in radiation leakage.

There have been proposals to package food products in boxes or containers formed in part of a microwave reflective material such as aluminum foil having holes in selected areas. This was based on the idea that the microwave radiation would enter the holes and be reflected about within the package by the aluminum foil, thereby facilitating the heating of the product. The microwave energy actually acting on the food was moderated or attenuated in the hope of improving its distribution within the food thereby uniformly heating the food. This technique not only weakened and increased the cost of the package, but the use of perforated aluminum foil as a part of the package itself was found to be unsatisfactory. On the other hand, the present invention focuses or increases the microwave energy acting on the food thereby improving the efficiency of heating.

U.S. Pat. No. 4,190,757 describes a disposable microwave shipping, heating and serving package for food composed of a paperboard carton and a lossy microwave energy absorber which becomes hot when exposed to microwave radiation. The absorber heats the adjacent surface of the food by conduction to a sufficiently high temperature to provide searing or browning while microwave exposure controlled by a shield heats the inside. This is a very expensive structure compared with a metal foil pan and the energy absorber is wasteful of energy. This prior art arrangement does not focus or increase the microwave energy acting on the food.

In U.S. Pat. No. 4,230,924 there is described a food package which includes a flexible wrapping sheet of dielectric material capable of conforming to the shape of the food. The dielectric wrapping sheet has a flexible metallic coating, such as aluminum, in the form of a film or foil, the coating being subdivided into a number of individual metallic islands separated by non-metallic gaps. With this arrangement, a part of the microwave energy is converted into heat by the metallic coating so as to brown or crispen the adjacent food. The metallic coating is preferably contiguous to the food and the heat that develops is conducted directly into the surface of the food without having to be radiated through any intervening space. Once again, this arrangement does not focus or increase the microwave energy acting on the food as does the present invention.

It is the object of the present invention to develop a very inexpensive modification whereby the standard aluminum foil containers, e.g. pans, now used in the food industry may be used for heating within a microwave oven.

In accordance with this invention, it has now been discovered that the standard metal, e.g. aluminum, foil packaging containers can be used in microwave ovens provided they are used in association with a special cover which is spaced a distance from the surface of the foodstuff in the metal foil container.

More particularly, the present invention relates to a cover for metal containers which in terms of microwave energy, does not transmit reflected energy. Thus, the cover acts in a manner analogous with non-reflecting coatings in optics and permits passage of the microwave radiation into the container holding the foodstuff, while substantially preventing escape of microwave radiation reflected from the foodstuff surface and container bottom. In this manner the microwave energy is retained and concentrated within the container, resulting in more efficient and uniform heating of the foodstuff.

The present invention will be described in detail with the aid of some examples and with the aid of the accompanying drawings, in which.

Figure 1:
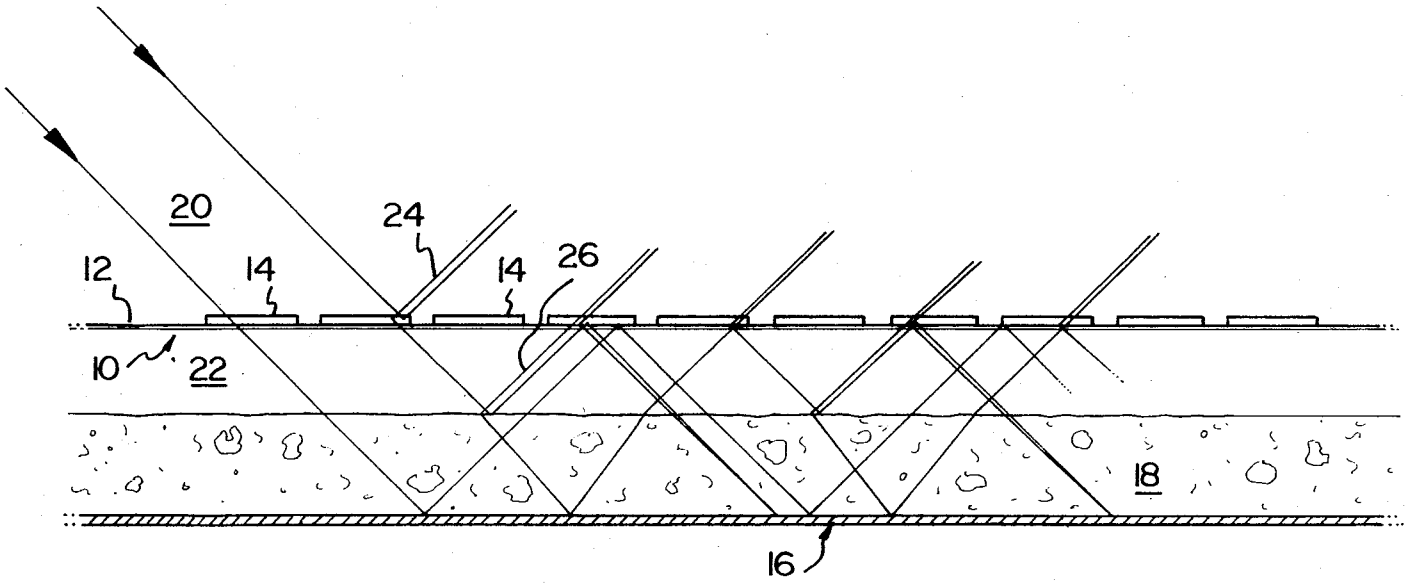
FIG. 1 is an idealized schematic diagram which explains the function achieved by the present invention.

The novel reflected energy impenetrable cover, referred to hereinafter as the "non-reflecting energy cover" or "cover" has a high effective dielectric constant and precipitates destructive interference with microwave radiation reflected from the foodstuff surface and container bottom. It is known that a high dielectric constant interface provides a reflection of energy at the interface. However, the present invention combines the use of a high dielectric constant interface with destructive interference so that the majority of microwave energy enters the container and the majority of microwave energy stays within the container and is absorbed by the foodstuff. The cover may be comprised of substantially uniform dielectric materials having dielectric properties as described hereinafter, and for which the characteristics of reflectance and transmittance are functions of thickness. The non-reflecting energy cover may also be in the form of an artificial dielectric comprised of metal powder or flakes dispersed in or on a dielectric substrate, for which the characteristics of reflectance and transmittance are at least equivalent to those obtained from the above uniform dielectric material. Alternatively, the non-reflecting energy cover may be comprised of arrays of conductors, e.g. metal or metal foil shapes, on or embedded in a dielectric substrate, the reflectance and transmittance characteristics thereof being at least equivalent to those which are obtained from the above uniform dielectric material.

The non-reflecting energy cover must be spaced from the surface of the foodstuff in the container and the distance between the cover and the surface of the foodstuff is determined by the properties and structure of the cover and also by the conductivity and dielectric constant of the foodstuff. In general, as the conductivity of the foodstuff increases, the optimum distance between the cover and foodstuff decreases. The distance between the cover and the surface of the foodstuff is usually in the range of about 0.8 to 2 cm., with the optimum being about 1.2 to 1.5 cm. at a microwave frequency of 2450 MHz.

For a flat foodstuff surface, the non-reflecting energy cover is preferably also flat and disposed substantially parallel to the foodstuff surface, although it may be contoured to improve uniformity of absorption of microwave energy by the foodstuff. If the surface of the foodstuff is curved, then the cover may also be provided with a similar curvature, so as to maintain a constant spacing from the foodstuff surface.

The substantially uniform dielectric materials used for the non-reflecting energy cover of this invention are dielectrics having dielectric constants greater than 10. These are exemplified by porous media containing labile water, the dielectric constants thereof being attributable to the presence of water, whose dielectric constant can approach 80.

Covers made of these substantially uniform dielectric materials must be quite thick, e.g. 0.4 to 1 cm. at an operating frequency of 2450 MHz., and also must be spaced from the foodstuff by a relatively small distance to be effective in blocking reflected energy. Because of the relatively small distance between the cover and the foodstuff surface, the effectiveness of this cover is very sensitive to unevenness in the foodstuff surface.

There was, therefore, a need for a non-reflecting energy cover material which could provide a thin cover having a high effective dielectric constant, e.g. more than 100. It has been found that a thin cover meeting these requirements can be obtained by using either metal powders or flakes dispersed in or on a dielectric substrate or arrays of metal or metal foil shapes on or embedded in a dielectric substrate.

The metal powder or flakes dispersed in or on a dielectric substrate create an artificial dielectric meeting the required characteristics of the invention. The metal powder or flakes may be applied in the form of paint or ink coatings having aluminum or bronze flakes dispersed therein. The minimum thickness of the metallic islands is determined by the size of the current circulating in each of the metal islands and that current's associated ohmic heating. By dimensioning the size of the islands it has been found that metallized islands as thin as 600 Angstroms have been operable. On the other hand, thicknesses for the metallic islands in the neighborhood of 0.001" have been found to be convenient.

The arrays of conductors on or in a dielectric substrate are exemplified by arrays of metal or metal foil squares or other geometrical shapes on a dielectric substrate, the dimensions of such squares or other shapes and the spacings therebetween being substantially less than one wavelength of the microwave energy. For best effects according to the invention, the area of the metal foil shapes should be 50 to 80% of the total area of the non-reflecting energy cover. The foil shapes are preferably arranged as islands, in that each shape is surrounded by a strip of dielectric. These shapes can vary quite widely in side dimensions, although it is desirable that each cover consist of a plurality of foil islands.

The dielectric substrates should be relatively low dielectric loss factor materials which are resistant to breakdown under microwave conditions. They are typically sheets or films of cellulosic or plastic resinous materials, and may, for example, include low dielectric loss papers, polyolefin film, such as polyethylene, polyester film, such as poly(ethylene terephthalate).

The microwave radiation enters the container through the novel non-reflecting energy cover. However, the very high effective dielectric constant of the cover, combined with the spacing of the cover from the surface of the foodstuff, creates a destructive interference with micro-wave radiation reflected from the foodstuff surface and container bottom. Since this results in the microwave energy being retained and concentrated within the container, energy is conserved in that the microwave energy is substantially all used to directly heat the foodstuff.

With the non-reflecting energy cover of this invention, fields have been created in the space between the foodstuff surface and the cover which may be as much as 80 times the field within the foodstuff. The result of this very high field is not only more uniform heating of the foodstuff, but also a highly desirable browning and/or crisping of the surface of the foodstuff. It will, of course, be appreciated that the cover may also be used together with a microwave transparent container to obtain the benefit of its ability to brown and/or crisp the foodstuff surface.

METHODS OF MEASUREMENT

The intense fields of microwave oven cavities preclude most conventional in situ measurements either of these fields or of local food temperatures. Thus, shielded probes or thermocouples are easily destroyed, with spurious readings being obtained from those remaining intact.

With the exception of recent IR scanning devices for sensing food surface temperatures, methods of measurement used both in the testing of foods and in oven design have remained crude, being generally based on temperature-rise measurements for water or actual food loads. Varying the position of a small water load in an oven might be used to determine constancy of the fields, while a large water sample is used to determine presumed maximum output. Power output for a water load is found by converting the heat absorption so determined into Watt units [$\Delta T(°C.)Xwt(gm.)\times 4.18400/t(sec)$]. Determination of the power absorbed by foods is less straightforward, owing to the generally wide fluctuations of temperature-rise observed. Moreover, the use of calorimetry to circumvent this problem is prone to error because of wide variations of food heat capacity with temperature. Furthermore, IR methods only provide surface temperatures, which are not necessarily indicative of bulk temperature distributions.

Power absorption by foods is governed by three quantities, as follows:

(1) dielectric constant, affecting the distribution of absorption, but not in itself contributing to absorption, (2) dielectric losses, resulting from relaxation processes, for example, and providing the major portion of food absorption, for foods with low electrolyte content, and, (3) electrical conductivity, caused by the presence of free ions through water and electrolyte dissociation, and giving rise to ohmic or near-ohmic losses.

In evaluating power absorption, conductivity and dielectric losses are grouped as a single loss term ("conductivity"). For many foods, it is found that both conductivity and dielectric properties are determined primarily by the presence of water, water being a major constitutent, and water conductivity and dielectric constant values being far greater than those of the other components present. Taking into account deviations of food properties from those of water, water power absorption measurements nevertheless provide a simple means of testing and simulating food performance in microwave ovens.

Various embodiments of the invention will now be illustrated by the following examples:

EXAMPLE 1

Water Absorption Results: Comparison of Foil Containers With Non-Reflecting Energy Covers Against Unmodified Containers Because of their simplicity of design, Alcan (trade mark) Catalogue No. 441-3 foil containers were used in this series of tests. This size of container is typical of many of the foil containers used in consumer frozen food applications (i.e.—the so-called "entree dish"). To best simulate performance with foods, these containers were filled with 310 gm of tap-water, it being felt that the electrolyte concentration of this water would give acceptably similar performance to that of a range of foods. In all cases, a Litton (trade mark) 80-08, 700 W commercial oven was used, this oven having similar wattage and a similar cavity size to a large portion of the consumer microwave oven market, with a microwave frequency of 2450 MHz.

It was found in the operation of this type of oven that the pyroceram floor exhibited varying temperatures during oven operation, presenting problems of experimental error. Accordingly, styrofoam spacers of about ⅛" thickness were used to provide thermal isolation from the oven floor, a small thickness being used to minimize perturbation of normal oven operation. When conductivity, presumably from the floor was considered, results with the spacer gave good agreement with the mean of ordinary test results. However, standard deviation was reduced to about 3.5% from the previous, nearly 10%. In all cases, to eliminate oven timer or relay error, oven operation was at the "HI" setting. Each series of runs was only commenced after an adequate oven warm-up interval.

(i) Unmodified Container Results:

Based on six runs of 1 minute duration, a water temperature-rise of 16.5° C. was indicated, giving an absorbed power level of roughly 357 watts.

(ii) Non-Reflecting Energy Cover Comprised of Foil Square Arrays on Paper

Foil squares were carefully cut and mounted with adhesive on a dry paper. Squares were cut in 2 mm increments from 1 cm on a side to 2.4 cm, and were spaced in increments of 1 mm from 2 mm to 10 mm. Styrofoam spacers were cut in ¼" increments from ¼" to 1" in thickness, with a peripheral cross-section, so that the width of the resulting spacer frame was about ¼" to minimize any effect from the presence of the styrofoam. Blank tests with water and only the frame indicated no change in power absorption by the water. The non-reflecting energy covers described above were mounted with adhesive tape on the styrofoam supports, and temperature-rises for runs with 310 gm of water and of 1 minute duration noted. Results were as follows:

(a) in all cases, best power absorption usually occurred at support thicknesses of ¼" and ½".

(b) typical maximum temperature-rises were:

Square side

| (mm) | dt (C) | + % Chg. | P (W) |
|---|---|---|---|
| 10 | 21.0 | 27.3 | 454 |
| 12 | 21.0 | 27.3 | 454 |
| 14 | 20.5 | 24.2 | 443 |
| 16 | 22.5 | 36.4 | 486 |
| 18 | 23.0 | 39.4 | 497 |
| 20 | 22.0 | 33.0 | 476 |
| 22 | 23.5 | 42.4 | 508 |
| 24 | 24.0 | 45.5 | 519 |

In each of these tests, a substantial improvement of power absorption resulted from use of the non-reflecting energy covers, the largest improvement generally corresponding to a range of foil area of from 50 to 80% of total cover area, the non-reflecting energy covers having typical dimensions of 14.1 by 11.3 cm. It is believed that power absorption was limited by dielectric strength of the paper and by lack of precision in preparation and mounting of the foil squares.

EXAMPLE 2

Foil Squares On Other Substrates (a) Using the foregoing procedure and non-reflecting energy covers using foil squares 22 mm on a side mounted on 0.0045" Mylar ® and 0.010" oriented polystyrene sheet at ½" separation from a fill comprised of 310 gm of water, temperature-rises of 22.0° and 23.5° C. were recorded, respectively, representing 33.3 and 42.4% improvements, and power levels of 476 and 508 watts.

The greater temperature-stability of the Mylar substrate permitted extended runs. For 2 minute runs, the blank gave a 24.0° C. temperature rise, while a Mylar non-reflecting energy cover using foil squares 2.2 cm on a side gave a 43.5° C. rise, for an improvement of 81.3%, and respective power levels of 259 and 470 watts. Comparative experiments were also run for the thawing of ice at −20° C.

(b) Using the same non-reflecting energy cover, thawing, gauged by the weight of liquid as a function of time, was about 20% more rapid, and melting was qualitatively more uniform than for the unmodified container.

EXAMPLE 3

Use of Compositions of Metal Particles in Dielectric-Aluminum Paint

Non-Reflecting energy covers were prepared using stationary paper, as before, to which was applied compositions of ordinary, domestic aluminum spray paint. In attempting to achieve as uniform coverage as possible, paint thicknesses of about 0.001" were obtained. The resulting non-reflecting energy covers were mounted on a ½" styrofoam support, as discussed above, and power absorption results for 310 gm water samples were compared with previous blank results. A typical temperature rise of 20.0° C. was obtained, representing an absorption increase of 21.2% and a power absorption rate of 432 watts.

EXAMPLE 4

Commercial Foods Products

1. PROCEDURE: A basic calorimeter was constructed, using a polyethylene box of sufficient size to accommodate a food sample, and 800 ml of water, or 1200 ml of water alone, such that 2" thick styrofoam box enclosed the polyethylene box. The styrofoam box was lined with aluminum foil, as was its cover, and the cover was gasketed with a double bead of silicone rubber material. Subsequent to microwave oven heating of a food sample, the sample was placed in the polyethylene box with 800 ml of water and a thermometer, both box and thermometer being pre-equilibrated to the water temperature, and the polyethylene box was placed within the enclosing styrofoam box for a sufficient interval to give equilibration between the food and with the water, thermometer, and polyethylene box, this interval ranging from 6 to 10 minutes. It was found that for a 1200 ml water blank run, and a temperature difference of 4.5° C. between the water (and polyethylene box) and room, the heat loss was only of the order of 4.5 watts over a 10 minute measuring interval. Combined water, thermometer, and polyethylene box heat capacities were calculated at 893.5 cal/C.

2. TYPICAL FOOD TEST: Using Stouffer® "Scalloped Chicken and Noodles" samples obtained directly from the manufacturer and nominally weighing 326 gm, which use the Alcan Catalogue No. 445-3 foil container, comparative tests were run. Samples with the foil/cardboard liner removed were heated for 6 minutes, and then tested according to the procedure noted above. For the unmodified blank, a food temperature-rise of 29.0° C. was noted, while the water (and polyethylene box) temperature-rise was 8.0° C. With a non-reflecting energy cover at an approximately 13 mm separation from the fill and using 20 foil squares 22 mm on a side, the respective temperature-rises were 31.5° and 10.5° C. Assuming a food heat capacity of 0.7, the modified container showed a 20.2% increase in absorption over the blank.

The present invention will now be described with respect to the figures.

FIG. 1 is an empirical representation of the effect of the present invention. A cover having an effectively high dielectric constant is shown at 10. This cover is comprised of a dielectric material lid 12 having a plurality of metallic islands 14 located thereon. The combination forms a dielectric array top. The metallic islands can be rectangular and have widths and lengths which are advantageously less than one-quarter wavelength of the microwave energy. It is preferred that they have dimensions which are less than one-half a wavelength in order to avoid the propagation of modes which yield high electric field voltages along the perimeters of the islands to prevent arcing. It has been found that a high effective dielectric constant can be achieved using many small islands which provide good initial transmission of the microwave energy into the volume defined by the pan and lid.

A ground plane 16 is provided either by using a metallic pan having a metallic bottom and sides or by a non-metallic pan having a conductive bottom intimately associated therewith. Such a bottom could be a metallic foil applied to a paper or plastic pan.

FIG. 1 does not show the pan which is basically irrelevant to the invention as long as a metallic ground plane is provided. It should be noted that a ground plane is not essential to the operation of the invention since the foodstuff itself can be considered to be poor ground plane. However, optimum results are achieved using a ground plane as will be seen from FIG. 1.

A foodstuff 18 to be heated is located directly on the ground plane 16 and spaced below the array dielectric top 10. As was mentioned above, this spacing ranges from between 0.8 and 2 cm. at the currently used microwave frequency of 2450 MHz. It should be noted that this range of spacing will change if the microwave frequency is altered and is more generally expressed as from $\lambda/15$ to $\lambda/6$ of a wavelength of the microwave energy used.

The action of the combination of array dielectric top, foodstuff and ground plane is very schematically shown in FIG. 1. Destructive interference in the plane of the high dielectric top accomplishes the desired effect. Incident energy 20 arrives at the top plane and the majority of the energy enters air space 22 and foodstuff 18. A small amount of the energy 24 is shown being reflected from the top plane. The energy which passes through the top plane enters the foodstuff 18 which, because it is lossy, absorbs energy and is cooked. Some of the energy passes through the foodstuff and is reflected from the ground plane 16 and is retransmitted through the foodstuff 18 where it is further absorbed. Some of the energy 26, is reflected directly from the surface of the foodstuff. The energy which was not absorbed by the foodstuff in its first reflection from the ground plane arrives, once again, at the top plane where the vast majority is reflected back into the foodstuff. This process is continued until all the energy is either absorbed by the foodstuff or transmitted back out into the general interior of the microwave oven through the top plane. The ratio of energy absorbed by the foodstuff to the energy escaping from the top plane has been found to be very high. This process results in a very efficient concentration of energy within the container holding the foodstuff and the advantageous result of an even cooking of the foodstuff in the horizontal plane.

As can be seen from FIG. 1 a small degree of reflection does take place in the plane of the cover. However, since the amount of reflection is so small the term "non-reflecting energy cover" is maintained throughout the disclosure.

Figure 2:
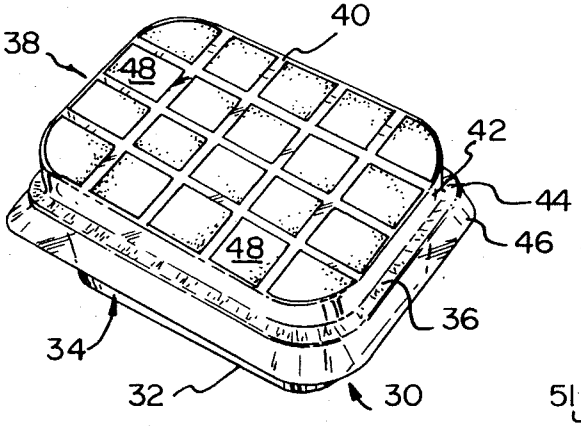
FIG. 2 is a perspective view of an example of the present invention employed on a general rectangular pan.

FIG. 2 shows a generally rectangular container 30 containing a foodstuff which fills the container to approximately the top. The container can be of a plastic material with a metallic ground plane (not shown) affixed to its bottom. A more preferable embodiment, and the embodiment shown, utilizes a metallic container having a bottom 32 and sides 34. A metallic lip 36 surrounds the top of the pan portion of the container. The container is completed with a lid 38. The lid is made of a dielectric material having a relatively low dielectric loss factor. An example of a suitable material is polyethylene polyester film.

The top 40 of the lid is generally flat and is orientated so as to be generally parallel to the surface of the foodstuff. A side region 42 is provided around the perimeter of the lid and mates with a circumferential step 44 which is designed to rest on lip 36 of the pan. The side region 42 has a height dimension which locates the top surface 40 within the range above the surface of the foodstuff described above. A preferred embodiment of the lid has a downwardly and outwardly sloping skirt 46 attached to the step 44. This skirt limits the proximity of the placement of the metallic pan to the microwave oven walls which effectively eliminates any possibility of arcing. The skirt also tends to lock or hold the lid on the pan by virtue of friction due to the lip of the pan.

Metallic islands 48 are placed on the top surface 40 and, as mentioned above, combine with the dielectric material of the lid to provide a region of effective high dielectric over virtually the entire surface area of the lid. The surface area of the metallic islands should preferably be between 50 and 80 percent of the surface area of the top of the lid 40. The array of islands 48 are shown in FIG. 2 as being rectangular islands forming a regular rectangular array. This particular configuration is not essential to the operation of the invention but has been found to function well.

Figure 3:
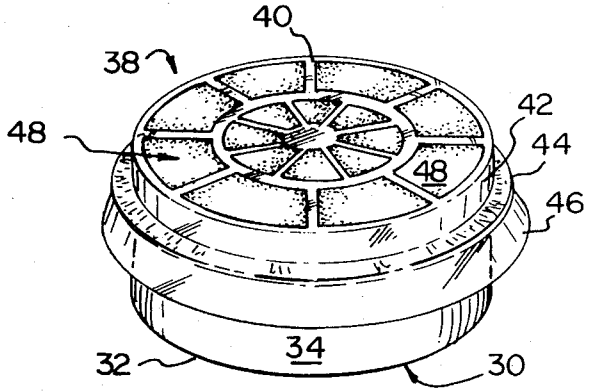
FIG. 3 is a perspective view of an example of the present invention employed on a generally circular pan.

FIG. 3 is the circular embodiment. In this figure elements which are the same as elements in FIG. 2 bear like reference numerals. The metallic islands 48 are arranged in two axially symmetrical rings. Once again, the configuration shown provides a metallic surface area which is in the neighborhood of from 50 to 80 percent of the surface area of the top 40. In the configuration shown there are six islands in the inner ring and eight in the outer ring. The configuration shown provides for an even heating of the foodstuff in the horizontal plane.

Figure 4:
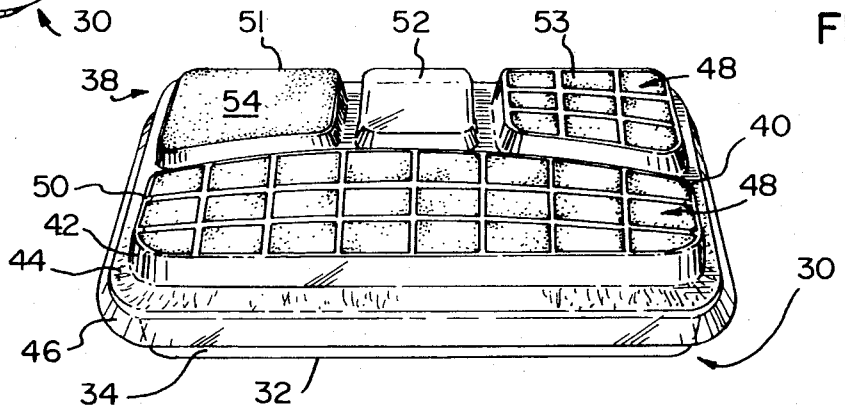
FIG. 4 is a perspective view of an example of a multicompartment pan utilizing the present invention.

FIG. 4 is a perspective view of a multi-compartment container for use in heating, for example, a "TV" dinner (trade mark). By using the process described above, a controlled heating of various compartments within pan 30 can be achieved. In FIG. 4, pan 30 includes outer side walls 34 and interior compartment walls which form compartments 50, 51, 52 and 53. Compartments 50 and 53 contain foodstuffs requiring high heating as, for example, meat and potatoes. In order to do this, an array dielectric consisting of dielectric material 40 and metallic islands 48 is located on the lid 38 directly over these compartments. A high heat concentration and uniformity of heating is achieved in these compartments as was discussed above. Compartment 52 requires medium heating to warm, for example, a frozen dessert, and therefore merely has the dielectric material directly over it. Compartment 52 is heated in the conventional manner.

Compartment 51 contains, for example, a green vegetable and requires little heating. As a result, metallic shield 54 is affixed directly over this compartment. Sufficient microwave energy leaks around the shield to heat the contents of this compartment. In addition, the contents of the compartment are partially heated by conductive heating from the surrounding compartments.

In the embodiment shown in FIG. 4, various foodstuffs requiring various heating needs are heated so that all the foodstuffs are ready for consumption at the same time.

It should be noted that any of the covers described above can be fitted with venting apertures to allow steam generated in the cooking process to escape without deforming either the pan or cover.

It should also be noted that the cover described herein could be used with a rigid reusable dish or permanent cooking container and that the cover itself could be reusable.

I claim:

1. A package containing an article of foodstuff, said foodstuff having a top surface, said foodstuff being capable of being heated in a microwave oven which produces microwave energy at a frequency of 2450 MHz., comprising a foodstuff holding pan, said pan having a bottom, side walls and an open top and a non-relecting energy cover for said pan, said cover having a dielectric constant greater than 10 and being spaced from the top surface of the foodstuff a distance of about 0.8 to 2 cm., so that the dielectric constant of the cover and the spacing of the cover above the foodstuff permit the passage of said microwave energy through the cover into the package while interfering with reflected microwave energy within the package, thereby retaining and concentrating the microwave energy within the package.

2. A package according to claim 1 wherein the pan is a metallic pan.

3. A package according to claim 2 wherein said cover is comprised of a dielectric substrate having metal powder or flakes dispersed therein or thereon thereby providing said dielectric constant greater than 10.

4. A package according to claim 3 wherein the dielectric substrate is a low loss dielectric paper.

5. A package of food to be heated with microwave energy, comprising a foodstuff-holding pan having a bottom, side walls and an open top; a body of foodstuff contained in said pan and having a top surface; and a top cover for said pan having a dielectric constant greater than 10 and being spaced from said foodstuff top surface by a distance of between one-fifteenth and one-sixth of a wavelength of said energy, the dielectric constant and spacing of the cover permitting passage of microwave energy through the cover into the package while retaining and concentrating the microwave energy within the package, wherein said cover comprises a dielectric substrate bearing an array of conductors comprising a plurality of spaced-apart, electrically conductive islands cooperatively providing said dielectric constant greater than 10.

6. A package according to claim 5 wherein the islands are metal islands having side dimensions and spacing dimensions from each other of less than one wavelength of said microwave energy.

7. A package according to claim 5, wherein said pan is a metallic pan.

8. A package containing an article of foodstuff, said foodstuff having a top surface, said foodstuff being capable of being heated in a microwave oven which produces microwave energy at a frequency of 2450 MHz., comprising a metallic foodstuff holding pan, said pan having a bottom, side walls and an open top and a non-reflecting energy cover for said pan having a dielectric constant greater than 10 and being spaced from the top surface of the foodstuff a distance of about 0.8 to 2 cm., wherein said cover is comprised of arrays of conductors on or embedded in a dielectric substrate, said conductors being metal islands having side dimensions and spacing dimensions from each other of less than one wavelength of said microwave energy, and wherein the metal islands represent 50 to 80% of the total area of the cover.

9. A package according to claim 8 wherein the dielectric substrate is a cellulosic or plastic resinous sheet or film having a low dielectric loss factor.

10. A package according to claim 9 wherein the metal islands are aluminum.

11. A package according to claim 10 wherein the metal islands are generally rectangular or square.

12. A package according to claim 8 wherein the distance between the top of the foodstuff and the non-reflecting energy cover is about 1.2 to 1.5 cm.

13. A container for use in heating a foodstuff with microwave energy, said container including a generally rectangular metallic pan having a substantially flat bottom, outer side walls and inner partition walls forming a plurality of compartments, and, in at least one of said compartments, a body of foodstuff having a top surface; said container further including a cooperating top cover, said top cover having a shoulder portion which is comprised of an exterior shoulder portion and interior partition shoulders, generally congruent with said inner partition walls to thereby form a plurality of top surfaces, one over each of said plurality of compartments in a one-to-one correspondence, said exterior shoulder portion and said inner partition shoulders being dimensioned so as to elevate said plurality of top surfaces above said foodstuff from between one-fifteenth to one-sixth of a wavelength of said energy, said top cover comprising a dielectric material at each of said plurality of top surfaces, wherein selected top surfaces further include arrays of metallic islands so that said selected top surfaces form array dielectrics having dielectric constants greater than 10, and wherein other selected top surfaces include a metallic film or foil on substantially the entire surface area thereof.

14. A method of heating in a microwave oven which produces microwave energy at a predetermined frequency, a foodstuff in a foodstuff holding pan, the foodstuff having a top surface, comprising the steps of placing over the top of the pan at a distance of about one-fifteenth to one-sixth of a wavelength of said energy above the foodstuff a non-reflecting energy cover to constitute a package, said cover having a dielectric constant greater than 10, so that the dielectric constant of the cover and the spacing of the cover above the foodstuff permit the passage of said microwave energy through the cover into the package while interfering with reflected microwave energy within the package, thereby retaining and concentrating the microwave energy within the package; and exposing said package to microwave energy of said predetermined frequency for heating the foodstuff therein.

15. A container for use in heating a foodstuff having a top surface with microwave energy comprising a foodstuff holding pan, a body of foodstuff contained in said pan and having a top surface, and a top cover, said top cover having a shoulder portion and a substantially planar top surface, said shoulder portion being dimensioned so as to elevate said planar top surface about from one-fifteenth to one-sixth of a wavelength of said energy above the top surface of said foodstuff, said planar top surface being comprised of an array dielectric, said array dielectric being comprised of a plurality of metallic islands located on a dielectric substrate, said array dielectric having an effective dielectric constant greater than 10.

16. The container of claim 15, wherein said pan has a metallic bottom which acts as a ground plane to said microwave energy.

17. The container of claim 15, wherein said pan is a metal.

18. The container of claim 17, wherein said pan and top cover are generally rectangular with curved corners and wherein said pan has a radially outwardly extending lip and said top cover has a radially extending step connected to said shoulder portion for frictional cooperation with said lip.

19. The container of claim 18, wherein a downwardly and outwardly extending, insulative skirt is attached to said step.

20. The container of claim 17, wherein said pan and said top cover are generally circular and wherein said pan has a radially outwardly extending lip and said top cover has a radially extending step connected to said shoulder portion for frictional cooperation with said lip.

21. The container of claim 20, wherein a downwardly and outwardly extending, insulative skirt is attached to said step.

22. The container of claim 15, wherein each of said metallic islands is comprised of a metallic film or foil bonded to said dielectric substrate.

23. The container of claim 22, wherein said film or foil is approximately 0.001 inches thick.

24. The container of claim 15, wherein the metallic islands have a total surface area which is between 50 and 80 percent of the surface area of the top surface.

25. The container of claim 15, wherein each of said metallic islands is comprised of a metallic film or foil embedded within said dielectric substrate.

* * * * *